United States Patent [19]

Vitale

[11] 4,380,902

[45] Apr. 26, 1983

[54] SEALED OIL-BACKED DISPLACER SUSPENSION DIAPHRAGM

[75] Inventor: Nicholas G. Vitale, Schenectady, N.Y.

[73] Assignee: Mechanical Technology Incorporated, Latham, N.Y.

[21] Appl. No.: 270,892

[22] Filed: Jun. 5, 1981

[51] Int. Cl.[3] ..... F02G 1/04

[52] U.S. Cl. ..... 60/520; 60/517

[58] Field of Search ..... 60/517, 520; 62/6

[56] References Cited

U.S. PATENT DOCUMENTS

| | | | |
|---|---|---|---|
| Re. 29,518 | 1/1978 | Franklin | 60/520 |
| 2,611,236 | 9/1952 | Kohler et al. | 60/24 |
| 3,400,281 | 9/1968 | Malik | 310/2 |
| 3,530,681 | 9/1970 | Dehne | 62/6 |
| 3,548,589 | 12/1970 | Cooke-Yarborough | 60/24 |
| 3,604,821 | 9/1971 | Martini | 417/379 |
| 3,645,649 | 2/1972 | Beale | 60/517 X |
| 3,805,527 | 4/1974 | Cooke-Yarborough et al. | 60/517 |
| 3,822,388 | 7/1974 | Martini et al. | 310/2 |
| 3,827,675 | 8/1974 | Schuman | 356/85 |
| 3,949,554 | 4/1976 | Noble et al. | 60/521 |

FOREIGN PATENT DOCUMENTS

| | | | |
|---|---|---|---|
| 1539034 | 1/1979 | United Kingdom | 3/2 |

OTHER PUBLICATIONS

Report No. NO1-HV-42901-6, to National Heart and Lung Institute Contract No. NO1-4-2901, R. P. Johnston, et al., Aug. 1979.

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A diaphragm suspension system for a free piston Stirling engine includes a transverse wall across the cold end of the displacer. An upper diaphragm is attached to the displacer shell above the transverse wall, and a support diaphragm is attached at its center to a partition fixed to the engine vessel, and is attached at its peripheral edge to the lower end of the displacer. A lower oil cavity is defined between the transverse wall and the support diaphragm, and an upper oil cavity is defined between the upper diaphragm and the transverse wall. A cylinder is formed in the transverse wall communicating between the oil cavities, and a piston is disposed in the cylinder and is fixed to the partition. When the displacer moves, the piston remains stationary and compensates for the oil displacement caused by the support diaphragm flexing into and out of the oil cavity, so the support diaphragm experiences only or primarily displacement induced stress rather than pressure induced stress. The top oil cavity ensures that leakage past the piston will be equal in both directions, and also provides an additional spring effect to return the displacer toward its midstroke position.

4 Claims, 1 Drawing Figure

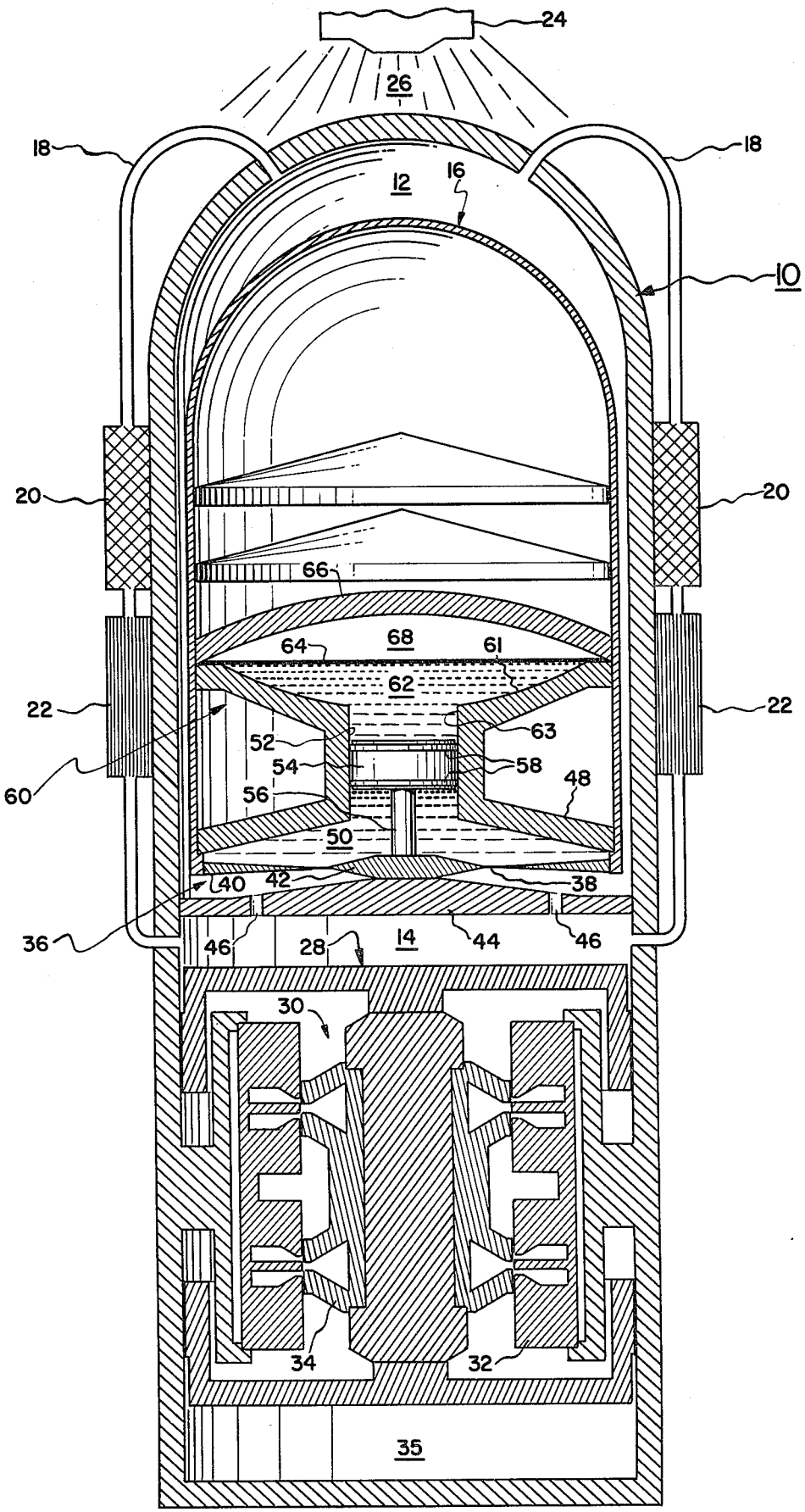
24
26
18
18
12
16
10
20
20
66
64
68
61
62
22
22
63
52
54
58
48
60
56
50
40
42
38
36
46
28
14
44
46
30
34
32
35

SEALED OIL-BACKED DISPLACER SUSPENSION DIAPHRAGM

BACKGROUND OF THE INVENTION

This invention relates to free piston Stirling engines, and more particularly to a sealed oil-backed diaphragm for suspending a free displacer in a free piston Stirling engine.

This invention is related to application Ser. No. 172,373 for "Diaphragm Displacer Stirling Engine Powered Alternator-Compressor," filed on July 25, 1980, by Folsom, et al., and to application Ser. No. 270,974, "Oil Backed Displacer Diaphragm," filed by Jeffrey S. Rauch concurrently herewith, the disclosures of which are incorporated herein by reference. The engine of the '373 application is a free piston Stirling engine which utilizes a diaphragm to suspend the displacer in the working space and uses the pressure wave in the working space to maintain the displacer oscillation. Although this machine, and the improvement disclosed in the 270,974 application constitute a significant improvement in the art, there are some areas in which modifications would improve their operation.

In the machine of the '373 application, the displacer diaphragm is subjected to stress induced by the pressure swing of the working gas in the working space which is on the order of 10%–20% of the charge pressure in the working space which can be on the order of 40–80 bar. Therefore, the pressure swing can be on the order of 4–8 bar which, acting over the full face of the diaphragm, can introduce considerable stress in the diaphragm. This complicates the deformation pattern of the diaphragm and reduces its working life. This pressure induced stress does not contribute to the operation of the machine. The only stress that is desirable as a design function is displacement induced stress, that is, the spring effect contributed by the diaphragm when it is displaced from its central position. This necessary and desirable stress in the diaphragm is compounded and multiplied in many ways and with deleterious results by the pressure induced stresses in the diaphragm so that the diaphragm design is greatly complicated and diaphragm reliability and repeatability is decreased. Moreover, the effect changes with pressure and therefore an additional degree of difficulty is encountered if a power control system based on mean pressure variation is introduced.

A second area of improvement which would be desirable is control of the power input into the displacer itself. Power input into the displacer is related to the ratio ($\Delta V/V$), where $\Delta V$ is the difference in the volumetric displacement of the displacer in the expansion space and the compression space, and V is the volumetric displacement of the expansion space. The power required to maintain the oscillation of the displacer in the working space, that is, to overcome the friction and windage losses of the working gas in the heat exchangers, normally requires a ($\Delta V/V$) ratio of approxmately 0.1. However, the value of approximately 0.3 is normal for a diaphragm in an engine of this variety. This provides more energy to the displacer than it needs and thus causes the displacer to slam back and forth between its stops unless some means is provided to extract the excess energy put into the diaphragm by the thermodynamic system. Alternatively, some technique must be provided for limiting the ($\Delta V/V$) ratio to a value more suited to the engine operation.

Along these lines, it is possible by artful design of a displacer to enable it to operate with the desired characteristic, that is, with a small ($\Delta V/V$). However, while the diaphragm is physically capable of operating in this manner, it is also capable of other patterns of displacement and there is no assurance that it will indeed perform in the desired manner when operated in the engine at various pressures and other operating parameters. Therefore, it is necessary to impose some form of restraint on the deformation pattern of the diaphragm in its operation so that it will conform to the desired configuration.

Another possible improvement that should enhance the diaphragm life and reliability in a reduction of the stress which the diaphragm must carry. The diaphragm is a mechanical suspension member that acts also as a spring to center the displacer and return it toward the hot end of the working space after its displacement toward the cold end by the pressure wave. The stress level in the diaphragm approaches the maximum allowed at the displacer stroke extremes. At these extremes, it would be desirable to have a supplementary spring member assume a portion of the load so that the diaphragm need not carry the entire load.

SUMMARY OF THE INVENTION

Accordingly, it is an object of this invention to provide a diaphragm displacer system for a free displacer in a free piston Stirling engine wherein the displacement volume produced by the deflection of the diaphragm is controlled. It is another object of this invention to control the pressure induced stresses to which the displacer is subjected. Yet another object is to provide a supplemental spring element to carry some of the displacer spring load at the displacer stroke extremes.

These and other objects of the invention are achieved in the preferred embodiments of the invention wherein a transverse wall across one side of the displacer forms one side of a cavity, the other side of which is formed by the displacer diaphragm. A volume adjusting device is provided which controls the cavity volume so that the diaphragm volumetric displacement is controlled by the cavity volume adjusting device. In this way, the working gas pressure can be transmitted through the diaphragm and the liquid in the cavity to the displacer and wall to limit pressure induced stresses in the diaphragm. A second diaphragm seals a second cavity above the transverse wall and prevents an accumulation of leakage around the volume control device, and also absorbs and stores some of the force exerted by the displacer at the extreme reaches of its stroke.

DESCRIPTION OF THE DRAWING

The invention and its many attendant objects and advantages will become better understood by reading the following description of the preferred embodiment in conjunction with the following drawing which is a sectional elevation of a free piston Stirling engine incorporating a diaphragm mounted displacer according to this invention.

DESCRIPTION OF THE PREFERRED EMBODIMENT

Referring now to the drawing, a free piston Stirling engine is shown having a hermetically sealed vessel 10 enclosing a working space including an expansion volume 12 and a compression volume 14 between which a displacer 16 oscillates axially. The oscillation of the displacer causes working gas to be circulated cyclically through a heater 18, a regenerator 20, and a cooler 22. The heater 18 is heated by combustion gases from a combustor 24 which burns liquid or gaseous fuel in a combustion space 26.

The lower end of the compression space 14 is defined by a power piston 28 which produces output power, in this case in the form of electrical power from a linear alternator 30. The alternator includes a stator 32 fixed to the interior wall of the vessel 10 and a plunger 34 which reciprocates opposite the stator 32 to switch the flux in the stator and induce electrical power in a manner taught by U.S. Pat. No. 3,981,874 to Rotors, et al.

A pressure wave is generated in the working gas in the working space when the displacer 16 oscillates. This pressure wave is caused by cyclic changes in temperature of the confined change of working gas as it passes through the heat exchangers. That is, as the displacer moves upwardly into the expansion volume 12, it displaces working gas from the expansion volume, through the heater 18, into the regenerator 20 where the heat from the working gas is deposited, and then into the cooler 22 where the working gas is cooled before flowing into the compression space 14. In the compression space, the working gas is compressed in a cold state by the upwardly moving piston 28 in the isothermal compression phase of the Stirling cycle. The displacer 16, which at this point is at its uppermost position in the working space, then begins to move downwardly, displacing cold compressed working gas from the compression space 14 back through the cooler 22 and the regenerator 20 where it picks up the heat which it deposited on the previous pass, and then into the heater 18 where it is raised to the design high temperature. The high temperature gas then expands into the expansion space 12. The resultant pressure increase acts against the piston 28, driving it downwardly to produce an output power stroke.

The downwardly moving power piston 28 compresses working gas in a bounce space 35 between the lower end of the vessel 10 and the lower end of the piston 28. The gas in the bounce space acts as a spring to store energy on the piston power stroke and then return it to the piston 28 on the upstroke or compression stroke.

A diaphragm system 36 is mounted at the lower or cold end of the displacer 16 and provides the mounting suspension for radial and axial support of the displacer in the working space. It also provides the means for deriving sufficient work from the working gas pressure wave in the working space to overcome the viscous and friction losses of the oscillating displacer in the working space and thereby maintain the displacer oscillation. The third function of the diaphragm system is to provide a spring effect so that the displacer is returned toward its midstroke position after it is displaced by the working gas pressure wave.

The diaphragm support system 36 includes a diaphragm 38 connected at its outer peripheral edge 40 to the lower inner peripheral edge of the displacer 16. The diaphragm 38 is connected at its center 42 to a partition 44 rigidly mounted at its outer edge to the vessel 10. A series of holes 46 are formed through the partition 44 to communicate the gas pressure in the compression space 14 to the undersurface of the diaphragm 38.

A rigid wall 48 is attached to the lower end of the displacer 16 adjacent the outer edge 40 of the diaphragm 38. A cavity 50 is defined between the diaphragm 38 and the rigid wall 48 which constitutes a solid backing or bounding member for the cavity 50. The cavity 50 is filled with an incompressible liquid such as hydraulic fluid which transmits pressure forces exerted on the diaphragm to the rigid wall 48 and thence to the displacer.

The volumetric displacement of the diaphragm 38 in the cavity is accommodated, and the cavity volume is controlled by a volume accommodating and control system which includes an upstanding cylinder 52 formed coaxially on the rigid wall 48 and slidably receiving an element such as a piston 54 axially fixed to the partition 44 by a post 56. A set of piston rings 58 is mounted on the piston 54 to prevent leakage of hydraulic fluid from the cavity 50 between the cylinder 52 and piston 54.

In operation, the diaphragm 38 is subjected to displacement induced stresses when the displacer moves from the midstoke position illustrated in the drawing. These stresses are stored as spring forces which tend to return the displacer toward the midstroke position when it is displaced upward or downward from the midstroke position.

The diaphragm is also subjected to gas pressure forces from the pressure wave in the working space. These pressure forces, if unrestrained, would tend to distort the diaphragm. For this reason, the volume of the cavity 50 is controlled by the piston 54 which acts as a movable wall in the cylinder 52. The piston 54 is actually stationary with respect to the vessel 10 and the cylinder 52 moves with respect to the stationary piston 54. The diameter of the piston is selected so that the cavity volume change produced by the displacement of the diaphragm 38 toward or away from the rigid wall 48 is just compensated by a volumetric change in the cavity produced by movement of the cylinder 52 with respect to the piston 54.

The configuration of the diaphragm 38 is selected to produce maximum deflection near the center of the diaphragm so that the volume swept by the diaphragm is about 90% of the volume swept by the top end of the displacer 16. This produces ($\Delta V/V$) ratio close to the desired value of about 0.1. However, the diaphragm, while designed to be capable of this pattern of deflection, is also capable of other deflection patterns which produce displacement values other than the designed value. Therefore, the diaphragm system 36 is designed to constrain the diaphragm 38 to deflect in the desired manner. This is achieved by regulating the internal volume of the cavity 50. Since the liquid in the cavity 50 is incompressible, the volumetric displacement of the diaphragm 38 must exactly equal the volumetric displacement of the piston 54 in the cylinder 52 when the displacer moves. In this manner, it is possible to precisely design the $\Delta V$ component of the ($\Delta V/V$) ratio so that this ratio can correspond to the power requirements of the displacer.

A clam shaped top section 60 of the diaphragm system 36 is formed on the top of the cylinder 52, and includes a rigid concave bottom wall 61 forming the sloping side walls of a second or top cavity 62. The center of the bottom wall 61 has an opening 63 which makes the top face of the piston 54 the effective center of the bottom wall of the cavity 62. The top wall of the cavity 62 is formed by a flexible planar diaphragm 64 welded to the displacer side wall or to the top of the concave wall 61. The cavity 62 is filled with the same liquid that fills the cavity 50. A downwardly facing concave support wall 66 is fastened to the displacer above the diaphragm 64 to prevent excessive deflection of the diaphragm 64. The gas space 68 between the diaphragm 64 and the underside of the support wall 66 can be sealed to provide a gas spring to assist the mechanical spring effect of the diaphragm 64, to be described below.

The operation of the cavity 62 will now be explained in terms of its function, which is to prevent a net leakage flow out of the cavity 50 between the piston 54 and the cylinder 52, and to provide an additional spring effect for the displacer and thereby relieve the diaphragm 38 of some of its load. As the displacer 16 moves downwardly under the influence of the pressure wave in the working space acting on the differential areas of the displacer, the diaphragm 38 flexes downwardly at its outer peripheral edge while remaining stationary at the center 42 where it is attached to the transverse partition 44. This deflection causes the diaphragm 38 to occupy portions of the cavity 50 by, in effect, flexing upwardly at its center into the cavity 50. The liquid in the cavity 50 which is displaced by the diaphragm 38 is accommodated by the relative upward movement of the piston 54 in the cylinder 52 so that the internal volume of the cavity 50 remains substantially constant. In this way, it is possible to isolate the diaphragm 38 from stresses which would otherwise occur as a result of pressure wave in the working space so the pressure induced stress to which the diaphragm is subjected can be controlled, and the primary operative stress is that which results from the displacement of the displacer 16 when it oscillates axially in the working space.

It is desirable to accommodate the leakage which would normally occur between the piston 54 and the cylinder 52 to prevent an accumulated change in the volume of the liquid contained in the cavity 50. To this effect the sealed liquid cavity 62 is provided so that whatever leakage occurs during one phase of the displacer operation will be matched by an equal and opposite leakage from the cavity 62 and toward the cavity 50 in another phase of the displacer operation so that the cummulative leakage is zero.

Downward movement of the displacer 16 causes the piston 54 to move upward relative to the cylinder 52 so that the fluid in the cylinder 52 is displaced upward in the cavity 62. This displacement of fluid in the cavity 62 is accommodated by upward flexing of the flexible diaphragm 64. The pressure induced stress in the diaphragm 64 is a form of energy storage which can be returned to drive the displacer toward its midstroke position in which the diaphragm is unstressed. In this way, the spring effect of the diaphragm 38, stressed by the displacement of the displacer 16, is assisted by the spring effect of the diaphragm 64 under the influence of fluid pressure in the cavity 62. The flexing or displacing of the diaphragms 38 and 64 are each limited to the particular form of displacement induced effects (namely, displacement and pressure) so that the design of each diaphragm is simplified and the cost and reliability of the diaphragms are optimized.

The diaphragm 64 can be a planar diaphragm whose stiffness is a function of the cube of its displacement. The stiffness of a convoluted or contoured diaphragm such as diaphragm 38 is nearly a linear function of displacement. Therefore, it is possible to design the diaphragm 64 to assume a major portion of the load at the stroke extremes of the displacer, which would occur seldom, and for the diaphragm 38 to bear the load during normal operation.

A further scheme for relieving the diaphragm 38 of its load at stroke extremes is the gas spring cavity 68. When the diaphragm 64 flexes during displacer oscillation, the pressure in the gas spring cavity 68 will tend to act in support of the diaphragm 64 to relieve the stress load thereon. Thus, the stress load which otherwise would be borne by the diaphragm 38 alone, is shared in this invention among the two diaphragms 38 and 64, and by the gas spring volume 68.

Obviously, numerous modifications and variations of the disclosed preferred embodiment will occur to those skilled in the art upon reading the foregoing disclosure, and therefore it is expressly to be understood that these modifications and variations, and the equivalence thereof, may be practiced while remaining in the spirit and scope of the invention as defined in the following claims, wherein I claim:

1. A displacer suspension system for a free piston Stirling engine having a hermetic vessel enclosing a working space adapted to contain a working gas and in which oscillates a displacer for displacing working gas back and forth between an expansion space in said working space serially through a heater, a regenerator, a cooler, and into a compression space in said working space, and then back again; said suspension system comprising:

a first diaphragm fixed at its center and outer edge to said vessel and said displacer so that said diaphragm flexes between concave and convex shapes when said displacer oscillates;

a rigid wall fastened to said displacer and extending generally parallel to said diaphragm; said rigid wall and said diaphragm bounding two sides of a first cavity adapted to be filled with an incompressible liquid;

a piston mounted in said vessel and axially fixed with respect thereto;

a cylinder formed in said rigid wall and receiving said piston for relative axial movement therewith;

a second diaphragm sealed at its outer peripheral edge to said vessel and having one face defining with said rigid wall a second cavity adapted to be filled with said incompressible liquid, said cylinder communicating between said cavities and being substantially sealed by said piston, said second diaphragm flexing when said displacer moves from its center position and storing energy in so flexing that is returned to said displacer to restore said displacer from an extreme axial position toward said center position;

whereby axial oscillation of said displacer causes said cylinder to reciprocate relative to said piston and causes said first diaphragm to flex between said concave and convex shapes, thereby displacing liquid in said first cavity, which liquid displacement is accommodated by movement of said piston in said cylinder, and leakage between said cylinder and said piston being contained by and returned from said second cavity.

2. The displacer suspension system defined in claim 1, wherein said first diaphragm is connected at the outer peripheral edge thereof to said displacer, and connected at its center to said vessel.

3. The displacer suspension system defined in claim 2, further comprising a rigid, aperatured partition fastened to said vessel between said first diaphragm and said power piston and attached to said center of said displacer.

4. The displacer suspension system defined in claim 1, further comprising a top rigid wall facing the other face of said second diaphragm and defining therewith a gas spring cavity.

* * * * *